United States Patent [19]

Jones et al.

[11] Patent Number: 4,519,571

[45] Date of Patent: May 28, 1985

[54] FLUID OPERATED, AXIALLY RECIPROCATING ACTUATOR

[75] Inventors: Marvin R. Jones; Roland M. Howard, Jr., both of Houston, Tex.

[73] Assignee: Koomey Blowout Preventers, Inc., Houston, Tex.

[21] Appl. No.: 650,572

[22] Filed: Sep. 14, 1984

Related U.S. Application Data

[63] Continuation of Ser. No. 461,761, Jan. 31, 1983, abandoned.

[51] Int. Cl.[3] ..... E21B 33/06

[52] U.S. Cl. ..... 251/1 A; 251/94; 92/24; 92/27

[58] Field of Search ..... 251/1 R, 1 A, 94; 92/23, 24, 27, 28; 188/67

[56] References Cited

U.S. PATENT DOCUMENTS 3,420,144 1/1969 Berry ..... 91/45
3,918,346 11/1975 Ziegler ..... 89/37 C
3,941,141 3/1976 Robert ..... 137/1
4,052,995 10/1977 Ellison ..... 137/1
4,305,565 12/1981 Abbe ..... 251/1 A

FOREIGN PATENT DOCUMENTS 465470 9/1975 U.S.S.R. .
759700 9/1980 U.S.S.R. .

*Primary Examiner*—Samuel Scott
*Assistant Examiner*—Allen J. Flanigan
*Attorney, Agent, or Firm*—Vaden, Eickenroht Thompson & Jamison

[57] ABSTRACT

There is disclosed a blowout preventer having rams each of which is moved between opened and closed positions by a fluid-operated actuator having a rod adapted to be axially reciprocated by piston means within a cylinder and extending from the cylinder for connection to the ram, means for locking the rams in closed position including locking elements carried by the rod for movement into locking position within the cylinder automatically in response to movement of the ram with the rod into closed position.

32 Claims, 5 Drawing Figures

FLUID OPERATED, AXIALLY RECIPROCATING ACTUATOR

This is a continuation of application Ser. No. 461,761 filed 1/31/83, now abandoned.

This invention relates in general to a fluid operated actuator having a rod extending from an inner end of the cylinder thereof for axial reciprocation between inner and outer positions in response to the supply and exhaust of operating fluid to and from outer and inner sides, respectively, of piston means within the cylinder. More particularly, this invention relates to improvements in actuators of this type wherein the rod is locked against return movement to its outer position automatically in response to movement into its inner position, whereby operating fluid may be exhausted from the outer side of the piston means, following which the rod may be unlocked for return movement automatically in response to the end-for-end reversal of the supply and exhaust of operating fluid to and from opposite sides of the piston means. In one of its aspects, the actuator of this invention is well suited for use in moving the rams of a blowout preventer between opened and closed positions, particularly when the preventer is underwater or at some other remote location.

In the operation of a blowout preventer, one ram will normally move inwardly into the bore of the preventer housing prior to inward movement of the other ram. In order to insure tight sealing engagement between the front faces of the rams, and about a pipe which might be in the bore, the one ram is allowed to travel beyond the position it would occupy if both rams moved in simultaneously to engage along the centerline of the bore of the housing. Furthermore, as the packing on the front face of one or both rams wears, it may be necessary to move the rams inwardly additionally compensating distances, thus requiring adjustment in the operating system and/or stops for limiting inward movement of the rams.

On page 1432 of the 1980–81 issue of the *Composite Catalog of Oil Field Equipment & Services,* a ram operating system is shown in which the rams may be locked in closed position by a wedge-shaped locking element arranged to slide laterally over a complementary surface on the outer end of the ram control rod in response to supply of operating fluid to the outer side of a piston on the locking element. These locking surfaces form an angle with respect to a plane perpendicular to the rod axis which is less than the friction angle, so that the locking element will remain in locking position upon exhaustion of operating fluid from the outer side of the piston, and despite forces tending to open the rams, and will also automatically compensate for packing wear by sliding further over the end of the rod. Over and above the fact that it is not automatic in the sense that it requires manipulation of suitable controls in proper sequence with opening and closing of the rams, this device is of such construction that, upon the exhaustion of operating fluid, it may develop load paths due to outward forces on the rod which include previously unloaded elements, and, as a result, the rams may be permitted to back off from their closed positions an excessive amount.

U.S. Pat. No. 3,242,826 shows a device in which locking elements carried by the control rod for operating a blowout preventer ram or other valve member are moved with the rod into locking engagement with a locking shoulder in a cylinder automatically in response to the supply of operating fluid to the outer side of piston means within the cylinder for moving the ram to closed position. The locking elements are wedged outwardly into and held in locking position by means of a locking ring or sleeve on an inner piston slidable over the rod and within an outer piston on the rod. Thus, the ring has an outer cylindrical surface slidable within inner cylindrical surfaces of the locking elements so that operating fluid may be exhausted from the outer side of the piston means. Operating fluid may then be supplied to the inner side of the piston means to move the locking ring outwardly from within the locking elements, and thus permit them to be withdrawn from locking position with the rod.

U.S. Pat. No. 4,304,565 shows a device of this latter type in which locking surfaces between the inner sides of the locking elements and the outer side of the locking sleeve form an angle with respect to the rod axis which is less than the friction angle, so as to hold the rod in its inner position, but which nevertheless permits the locking elements to slide inwardly and outwardly along the locking shoulder of the cylinder to a variety of locking positions, depending on the extend to which the rod moves inwardly and thus regardless of wear on the ram packing. Since the locking surfaces between the locking elements and the locking sleeve of the last-described device form such a small angle with respect to the rod axis, the sleeve transmits a relatively large radial component of the force which is due to operating fluid supplied to the outer side of the piston, to the locking elements as they are moved with the rod from its outer position to its inner position. As a consequence, it was apparently thought necessary to reduce this force on the locking elements and, thus, frictional drag of the locking elements with the inner diameter of the cylinder during inward movement with the piston and rod, by an arrangement of pistons with the cylinder including an outer annular piston on the locking sleeve having a relatively small cross-sectional area for moving the locking elements axially inwardly, and an inner piston sealably slideable in the outer annular piston and having a relatively large cross-sectional area for moving the rod inwardly. More particularly, the locking elements are carried by means of a cage about the rod so that if the locking elements act as a brake as they slide along the inner diameter of the cylinder, the rod will, through the case, transmit the force due to the large piston to the extent it is necessary to move the locking elements inwardly along the cylinder diameter and into position opposite the locking shoulder.

Because of its complex construction, the actuator of U.S. Pat. No. 4,304,565 is also particularly unsuited for use in a preventer of the type such as shown in copending application, Ser. No. 337,383, filed by Marvin R. Jones on Jan. 6, 1982, and entitled "Hydraulically Operated Valves". Thus, as shown and described therein, the ram control rod is hollow and extends through the outer end of the cylinder into a chamber in its bonnet so as to substantially balance forces acting in opposite directions on opposite ends of the rod, and thereby reduce the force required to move the rams to closed position. Considerable difficulty would be expected in fitting the dual piston arrangement of such patent within the relatively small annular space between the hollow rod and inner diameter of the cylinder.

It is therefore an object of this invention is to provide an actuator of this latter type which is also operable to move the rod and locking elements axially inwardly toward a variety of locking positions, but which is of a relatively simple construction and which does not cause excessive frictional drag between the locking elements and inner diameter of the cylinder of the actuator.

It is a more particular object of this invention to provide such a device which is well suited for an disposal within an annular space about a hollow control rod whose outer end extends into a balance chamber.

These and other objects are accomplished, in accordance with the illustrated embodiment of the invention, by an actuator of the type described in which means are provided for transmitting to the locking elements, and thus to the control rod, a relatively large axial component of the axially inwardly directed force due to operating fluid supplied to the outer side of the piston means in order to move the rod axially inwardly with the locking elements until the conical surfaces of the locking elements are radially opposite the cylinder shoulder, and then transmitting to the locking elements, and thus to the rod, a relative large radial component of such force in order to cause the locking elements to move radially outwardly with respect to the rod and the conical surfaces thereof to slide radially outwardly along the cylinder shoulder as the rod continues to move axially inwardly with the locking elements to its inner position. More particularly, the rod is locked against return movement from its inner to its outer position, upon exhaustion of operating fluid from said outer side of the piston, and means are also provided for tansmitting to the rod the axially outwardly directed force due to the supply of operating fluid to the inner side of said piston means and causing the locking elements to slide radially inwardly along the shoulder and then axially outwardly with the rod as the rod is returned to its outer position.

In the illustrated embodiment of the invention, the piston means includes an annular piston having an inner diameter sealably slidable along the rod and an outer diameter sealably slidable along the inner diameter of the cylinder. Preferably, the outer end of the rod is hollow and extends sealably through the outer end of the cylinder into a chamber outwardly of the cylinder and so as to be substantially pressure balanced, and the inner diameter of the annular piston is greater than the outer diameter of the outer end of the rod, so that the piston means also has a piston on the rod which is responsive to control fluid to urge the rod axially inwardly.

In the preferred embodiment of the invention, there is a stop on the rod on the inner side of the locking elements, a locking ring on the annular piston, and means on the locking ring and locking elements for transmitting to the locking elements, and thus to the rod, the above-described inwardly directed force due to the supply of operating fluid to the outer side of the piston. More particularly, there is another stop on the rod outwardly of the piston for transmitting to the rod the above described outwardly directed force due to the supply of operating fluid to the inner side of the piston. As illustrated, this means on the locking ring and locking elements comprises a first surface about the ring which is engageable with substantially complementary first surfaces on the locking elements to move the locking elements against the inner stop on the rod and thereby move the rod axially inwardly with the locking elements, and which is then slidable over said first surfaces to wedge the locking elements radially outwardly with respect to the rod for sliding along the cylinder shoulder as the rod and locking elements move further axially inwardly, in response to the supply of operating fluid to the outer side of the piston, and a second surface thereabout which is slidable over substantially complementary second surfaces on the locking elements, upon sliding of said first surface out of engagement with said first surfaces of the locking elements, so as to continue to wedge the locking elements radially outwardly for sliding further along said cylinder shoulder as the rod and locking elements continue to move axially inwardly and until the rod reaches its inner position, in response to the continued supply of operating fluid to the outer side of the piston.

More particularly, said first surfaces form a relatively large angle with respect to the rod axis so as to transmit a relatively small radial component of force to the locking elements, whereby there is a minimum of frictional drag between the locking elements and the inner diameter of the cylinder as the locking elements move toward locking position, and said second surfaces form a relatively small angle with respect thereto so as to transmit a relatively large radial component of force thereto as the locking elements are wedged outwardly along the locking shoulder. When operating fluid is supplied to the inner side of the piston, the second surface of the locking ring slides out of engagement with the second surfaces of the locking elements as the locking ring is moved axially outwardly to release the locking elements for sliding axially outwardly with the rod and radially inwardly along the cylinder shoulder.

As illustrated, the inner ends of the locking elements have conical surfaces which extend in a direction toward the inner end of the cylinder for sliding along a substantially complementary conical surface of the inner stop of the rod, during radial expansion and contraction into and out of locking position. Also, the locking ring comprises circumferentially spaced-apart fingers which are pressed tightly about the rod as the second surfaces of the ring move into sliding engagement with the second surfaces of the locking elements. Due to the resulting axially directed frictional forces between fingers and both rod and locking elements, the second surfaces of the fingers may extend at an angle with respect to the rod axis which is substantially larger than would be permissible if, as in prior devices of this type, there was substantially no frictional engagement of the locking ring with the rod. Consequently, the locking elements are moved into locking position at an accelerated rate. Still further, bolts connect the locking elements to the rod for guided radial movement with respect thereto, and one or more pins on the rod extend into one or more of the splits between the fingers so as to align the splits with the bolts for movement thereover as the locking ring moves within the locking elements.

In the drawings, wherein like reference characters are used throughout to designate like parts:

Figure 1:
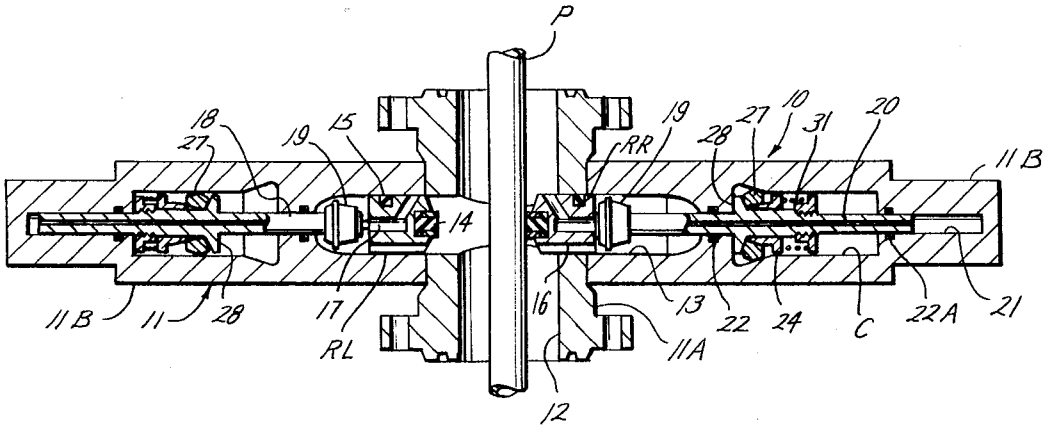
FIG. 1 is a vertical sectional view of a blowout preventer having rams which are operated by means of actuators constructed in accordance with the present invention, the right-hand ram being shown moved to its inner position to engage about a pipe in the bore of the preventer housing and the left-hand ram being shown in its withdrawn position.

With reference now to the details of the drawings, the blowout preventer shown in FIG. 1, and indicated in its entirety by reference character 10, comprises a housing 11 having a vertical bore 12 and adapted to be installed upon a wellhead, which may be at an underwater location, in the customary manner. A pipe P extending through the bore 12 may be a string of drill pipe extending from the water level into the well bore and having a bit on its lower end for drilling the well. For this purpose, drilling mud would ordinarily be circulated downwardly through the pipe, out the bit, and up the annulus between the pipe and bore 12.

Rams RR and RL are mounted within chambers 13 in the housing intersecting opposite sides of the bore 12 for movement between outer positions to open the bore (see the left-hand ram LR) and inner positions to engage one another and about the pipe P (see the right-hand ram RR) to close the bore. One ram normally moves inwardly before the other to a position which is limited either by engagement of the ram with a pipe in the bore, as in FIG. 1, or with a stop, or by engagement of parts of the operating system to be described. When both rams are moved to closed position, they seal with respect to one another and the housing chambers to contain pressure within the well, as will be described.

As shown, each ram has a vertical recess in its front face for fitting about the pipe P when moved into engagement therewith, as well as a packing 14 extending laterally across its front face, so that when both rams are moved to closed position, the packings sealably engage about the pipe as well as with one another on both sides of the pipe. As well known in the art, additional packing along the sides of each ram connect the ram face packing with a top packing 15 so as to form a continuous seal with one another and the chambers 13 when the rams are closed. As well known in the art, however, the rams may instead be "blind" rams for closing the bore when empty.

As also shown in FIG. 1, each ram has a groove 16 formed in its lower side to connect the bore 12 with the chamber 13 behind it, whereby well fluid is able to act over portions of the outer ends of the closed rams to supplement the force of the operating system in maintaining them in tight sealing engagement with one another and the pipe P. As also shown in the aforementioned copending patent application, each ram is moved between opened and closed positions by means of a control rod 18 axially reciprocable within a cylinder C in the housing outwardly of the ram chamber. More particularly, each ram has a passageway 17 formed therein which connects the chamber 13 behind the ram with its top side above the packing 14, and the inner end of the control rod has a lost motion connection with the rod which enables a valve head 19 thereon to open and close the outer end of the passageway. Thus, as the ram is moved inwardly with the rod to its closed position, a surface on the inner end of the valve seat engages a seat on the back of the ram surrounding the passageway so as to close the passageway, and thus enable well fluid to supplement the force of the operating system to maintain the ram closed. However, as the control rod is withdrawn or moved outwardly to return the rams to open position, so as to vent well fluid within the chamber behind the closed ram to the annulus of the bore 12 above the closed rams.

The operating system for each ram includes piston means 24 carried by the control rod and axially reciprocable within the cylinder C in order to reciprocate the rod and thus move the rams between closed and open positions in response to the supply and exhaust of operating fluid to and from opposite sides of the piston means. Fluid may be supplied through a port $P_1$ connecting with the outer end of the cylinder and exhausted through a port $P_2$ connecting with its inner end in order to close the ram, or, alternatively, supplied through the inner port and exhausted through the outer port to open the ram.

More particularly, and again as fully described in the aforementioned copending application, the outer end of each rod 18 extends sealably through the outer end of the cylinder and into a balance chamber 21 in the housing outwardly of the cylinder C, and a hole 20 therethrough connects the inner end of the rod within seating area of the valve head 19 with the balance chamber 21. Thus, as shown, the inner end of each rod extends through a seal ring 22 in an opening in the housing connecting each chamber 13 with cylinder C of the operating system, and the outer end of the rod extends through a seal ring 22A in an opening therein connecting the cylinder with the balance chamber 21. Assuming that the cross-sectional areas of the control rod extending through the seal rings 22 and 22A are substantially equal, the forces due to fluid pressure acting on opposite ends of the rods are at all times substantially balanced.

As previously mentioned, piston means 24 includes an annular piston 30 about rod 18 having an inner seal ring 30A sealably slidable along the rod and an outer seal ring 30B sealably slidable within the inner diameter of the cylinder. As shown, and as also previously described, the inner diameter of the piston 30, and thus the outer diameter of the intermediate part of rod over which the piston is sealably slidable, is larger than the outer diameter of the inner and outer ends of the rod. Consequently, the piston means also includes a piston area on the rod within the annular piston which is responsive to control fluid to provide a force for moving the rod axially.

The preventer housing includes a main body 11A in which bore 12 and the inner ends of chambers 13 are formed on opposite sides of the bore 12, and bonnets 11B in which the outer ends of the chambers, cylinders C and chambers 21 are formed. The bonnets are hinged or otherwise mounted on the main body as to permit them to be moved between the closed positions shown in FIG. 1, and open positions which enable the rams to be removed and replaced with respect to the control rods.

A conical shoulder 25 formed in the cylinder adjacent its inner end extends outwardly from the inner diameter of the cylinder in a direction toward its inner end. A series of circumferentially spaced-apart locking elements 26 are carried about the rod for radial expansion and contraction between the inner positions shown in FIG. 2, in which they are free to move within the inner diameter of the cylinder, and outer positions, such as shown in each of FIGS. 3 and 4, in which a conical surface 27 about each locking element, and substantially complementary to the cylinder shoulder 25, is disposed radially outwardly of the inner diameter of the cylinder for sliding along such shoulder into and out of locking position. More particularly, the locking elements are carried about the rod intermediate an inner annular stop 28 about the rod and the piston 30, and the piston 30 is in turn axially reciprocable along the rod intermediate the locking elements and an outer annular stop 31 about the rod.

Figure 2:
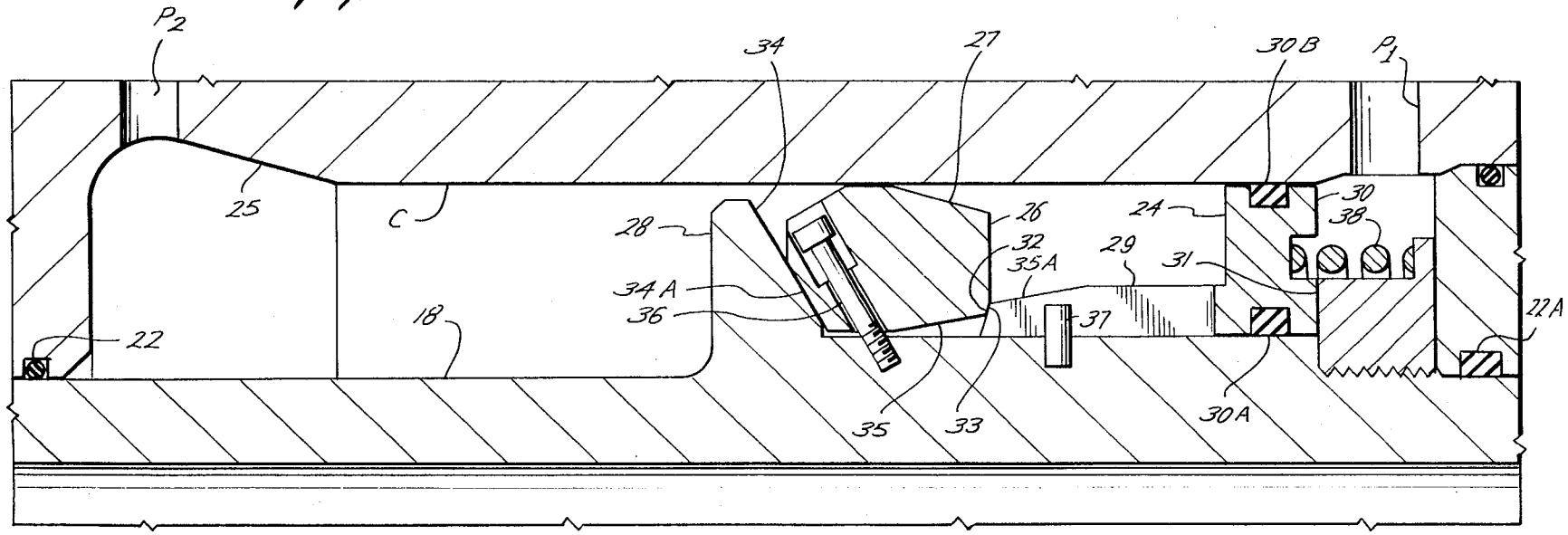
FIG. 2 is a vertical sectional view, on an enlarged scale, of the upper half of the actuator for the right-hand ram, but with the rod shown in its outer position to withdraw the ram to open position.

A locking ring 29 extends inwardly from the piston 30 for transmitting the force due to operating fluid supplied to the outer side of the piston to the locking elements, and thus to the stop 28, for moving the rod with the locking elements inwardly from the position of FIG. 2. As the locking elements 26 reach positions opposite shoulder 25, the locking ring will begin to wedge them outwardly and cause their outer surfaces 27 to slide along the shoulder as the rod continues to move inwardly with the locking elements. However, when operating fluid is instead supplied to the inner side of piston 30, ring 29 will be moved with the piston 30 outwardly along the rod to release the locking elements for radial inward movement, and the piston engages outer stop 28 to transmit the force due to such fluid to the rod for moving the rod with the piston toward its outer position as the surfaces 27 of the locking elements are wedged between inner stop 28 and locking surface 25 back to their inner positions. Of course, in both cases—i.e., whether the rod is being moved inwardly or outwardly—the force due to operating fluid acting over piston 30 is supplemented by the force due to such fluid acting over the piston area of the rod.

With the ram withdrawn to open position, and thus with the control rod 18 in its outer position, as shown in FIG. 2, piston 30 is engaged with outer stop 31, and the locking elements 26 are retracted radially inwardly to positions close about the rod, and thus for movement axially within the inner diameter of the cylinder. At this time, the inner ends 34A of the locking elements are adjacent a substantially complementary surface 34 on the outer side of stop 28, and a conical surface 32 on the inner end of the locking ring is adjacent substantially complementary surfaces 33 on the inner corners of the outer ends of the locking elements 26. Thus, as the piston 30 begins to move inwardly from the position shown in FIG. 2, the inwardly directed force due to operating fluid acting over its outer side to the piston is transmitted to the stop and thus the rod through the surfaces 32 and 33. As shown, these surfaces form a relatively large angle with respect to the axis of the rod so as to transmit a relatively large axial component, but a relatively small radial component of such force to the locking elements as they move axially inwardly within the inner diameter of the cylinder. Thus, although the locking elements may be wedged radially outwardly into engagement with the inner diameter of the cylinder to some extent, there will be a minimum of drag between them and the inner diameter of the cylinder, and thus a minimum of resistance to inward movement of the rod.

Figure 3:
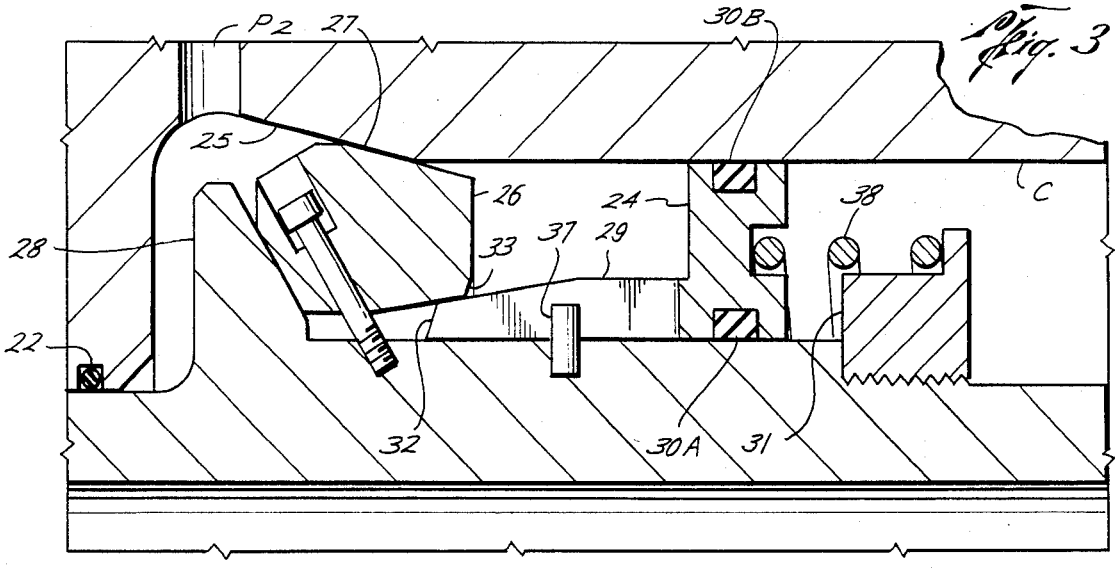
FIG. 3 is a view similar to FIG. 2, but upon inward movement of the rod and locking elements of the actuator to a position to which the locking elements are wedged outwardly along the locking shoulder of the cylinder as the ram is moved toward its closed position.
Figure 4:
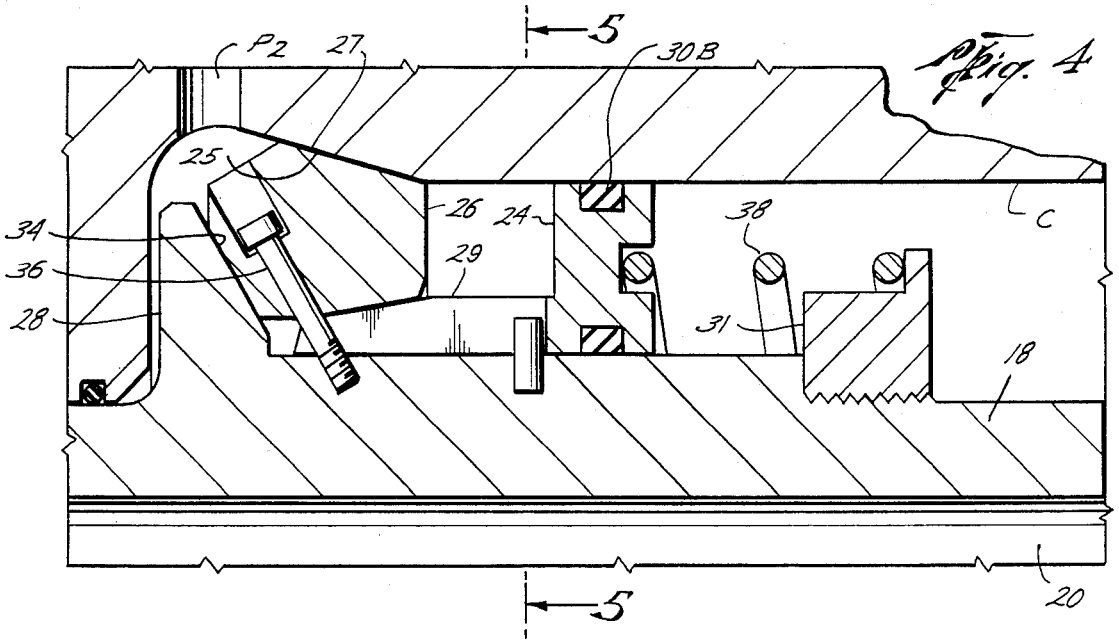
FIG. 4 is still another view similar to FIG. 3, but upon further inward movement of the rod to its innermost inner position to wedge the locking elements further outwardly along the locking shoulder as the ram is moved further inwardly to the closed position of FIG. 1.
Figure 5:
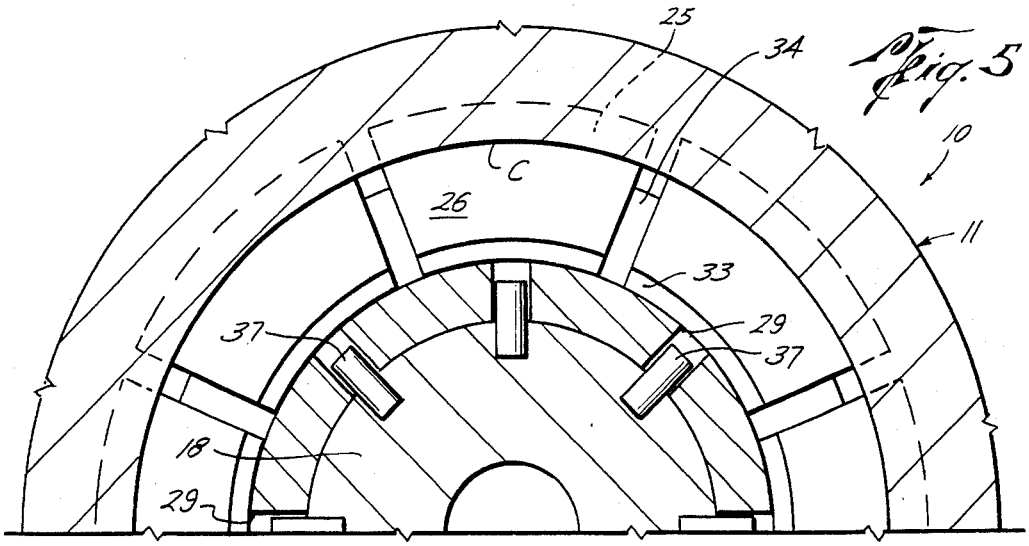
FIG. 5 is a cross-sectional view of the upper half of the actuator, as seen along broken line 5—5 of FIG. 4.

As the locking elements are moved into the position shown in FIG. 3 to dispose their locking surfaces 27 opposite the shoulder 25 on the inner end of the cylinder, the relatively small radial component of force will move them radially outwardly and thus cause them to begin to slide along the shoulder 25. Preferably, and as shown, the outer side 34 and the complementary surfaces 34A on the inner ends of the locking elements are conical and extend inwardly and outwardly with respect to the axis of the rod at a relatively steep angle, so as to facilitate sliding of the locking elements radially outwardly into locking position as well as radially inwardly out of locking position.

As the locking elements move radially outwardly an initial distance, the first surfaces 33 thereon will move out of engagement with the surface 32 on the inner end of the sleeve 29, and thus permit a surface 35 on the inside of each locking element to move over and about a substantially complementary second surface 35A on the outside of the sleeve 29. More particularly, these second surfaces intersect surfaces 33 at the corners of the locking elements and also extend outwardly and rearwardly with respect to the rod axis so as to continue to wedge the locking elements radially outwardly and axially inwardly for sliding along the locking shoulder 25 as rod 18 continues to move inwardly. However, the angle which these second surfaces 35 and 35A form with respect to the rod axis is relatively small, so that, at this stage, the locking elements are moved radially outwardly with a relatively large radial component of the force due to operating fluid acting on the outer side of the piston 30. As previously described, the extent to which the locking elements are moved radially outwardly and inwardly, as their locking surfaces 27 slide along locking shoulder 25 and the conical surfaces on their inner ends slide along the conical surface 34 on the inner side of the stop 28, is determined by the extent to which the rod must move inwardly in closing its ram.

As previously described, when the rams have been so moved to closed position, they are locked against return movement by the locking elements, so that operating fluid may be exhausted from the outer side of the piston 30, thereby relieving the overall operating system as long as the rams are to be maintained closed. For this purpose, the blocking surface of ring 29 preferably comprises a series of circumferentially spaced-apart fingers 29A which, upon sliding of their outer surfaces 35A within the surfaces 35 on the inside of the locking elements, are pressed tightly into frictional engagement with the rod. Thus, there is frictional resistance to outward movement of the rod not only along the surfaces 35 and 35A, but also along the inner diameters of the fingers and the rod.

The foregoing description will of course enable the angles which the various surfaces of the locking elements form with respect to one another to be selected by one skilled in the art. Thus, in order to ensure the locking elements' release, the angle formed between surfaces 27 and surfaces 34A must at least substantially equal the sum of their maximum anticipated respective friction angles. Also, in order to ensure maintaining a reliable lock during the time the fingers occupy a position blocking the locking elements, the angle formed between surfaces 35A and the axis of the rod must not exceed the sum of the minimum anticipated friction angle between the fingers and the locking elements and the minimum anticipated friction angle between the fingers and the rod. By way of example, however, the surfaces 35 may form an angle of about 10° and the surfaces 34A an angle of about 60° with respect to the rod axis. Thus, with locking surfaces 27 extending at an angle of about 15° with respect to such axis, they will form with surfaces 34A an included angle of about 45° for wedging the locking elements from their outer to their inner positions.

The locking elements are guided for limited radial expansion with respect to the rod by means of bolts 36 threadedly connected to the rod and extending through holes in the locking elements. The bolts have enlarged heads on their outer ends received in counterbores on the outer ends of holes to retain the locking elements on the rods. In order to permit the locking ring 29 to move to its innermost position within the locking elements 26, the splits between their fingers are held in alignment with the bolts by means of pins 37 mounted within the rod intermediate adjacent fingers. Obviously, a single such pin may be sufficient.

When the rams are to be moved to open position, operating fluid is supplied to the inner sides of the piston 30 and exhausted from the outer side thereof to move the piston outwardly along the rod until the surface 35A of the ring 29 are withdrawn from within the surfaces 35 on the inside of the locking elements. As the piston continues to move outwardly, its outer end engages the inner face of outer stop 31 to transmit a force to the rod which supplements that acting on the piston area of the rod to move the rod outwardly with the piston, and thus cause the locking surfaces 27 to slide along the locking shoulder 25 of the cylinder back into the retracted positions shown in FIG. 2. That is, upon sliding of the surfaces 35A of the ring 29 from within the locking elements, the locking elements are free to move radially inwardly and thus to be fully withdrawn into a position in which they are free to move axially outwardly within the cylinder C, as surfaces 33 slide radially inwardly along surface 32 as the rod continues to be moved outwardly. This outward movement will continue of course until the stop 30 moves into engagement with the outer end of the cylinder, at which time, the rams are withdrawn into the open positions shown in FIG. 1.

As shown, a coil spring 38 is disposed about the outer stop and within an annular recess on the outer side of piston 24 so as to yieldably urge the piston in an inward direction with respect to the stop. This may be desirable if there is some tendency for the piston to stick to the rod, or to the inner diameter of the cylinder, or to otherwise not be free to move axially inwardly in order to move the rod inwardly and the locking elements into locking position.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. An axially reciprocating, fluid-operated actuator, comprising a cylinder with a conical locking shoulder extending radially outwardly from its inner diameter and in an axial direction toward the inner end of the cylinder, a rod extending sealably through the inner end of the cylinder for axial reciprocation between inner and outer positions, piston means axially reciprocable within the cylinder, means by which operating fluid may be supplied to or exhausted from opposite sides of the piston means, locking elements carried about the rod for radial expansion and contraction between inner positions in which they are free to move within the inner diameter of the cylinder and outer positions in which conical surfaces on their outer sides which are substantially complementary to the conical shoulder of the cylinder project outwardly from said diameter, means for transmitting to the rod via the locking elements a relatively large axial component of the axially inwardly directed force due to operating fluid supplied to the outer side of the piston means in order to move the rod axially inwardly with the locking elements until the conical surfaces of the locking elements are radially opposite the cylinder shoulder, and then transmitting to the rod via the locking elements a relatively large radial component of such force in order to continue to move the rod axially inwardly with the locking elements to move radially outwardly with respect to the rod and the conical surfaces thereof to slide radially outwardly and axially inwardly along the conical cylinder shoulder as the rod continues to move axially inwardly with the locking elements to its inner position, said rod being locked against return movement from its inner to its outer position, upon exhaustion of operating fluid from said outer side of the piston means, and means for transmitting to the rod the axially outwardly directed force due to the supply of operating fluid to the inner side of said piston means and to cause the locking elements to slide radially inwardly and axially outwardly along the conical shoulder and then axially outwardly with the rod as the rod is returned to its outer position.

2. An actuator of the character defined in claim 1, wherein the piston means comprises an annular piston whose inner diameter is sealably slidable along said rod and whose outer diameter is sealably slidable along the inner diameter of the cylinder.

3. An actuator of the character defined in claim 1, wherein the piston means comprises an annular piston about the rod, and the rod is hollow and extends sealably through the outer end of the cylinder into a chamber outwardly of the cylinder so as to be substantially pressure balanced.

4. An axially reciprocating, fluid-operated actuator, comprising a cylinder with a conical locking shoulder extending radially outwardly from its inner diameter and in an axial direction toward the inner end of the cylinder, a rod extending sealably through the inner end of the cylinder for axial reciprocation between inner and outer positions, piston means axially reciprocable within the cylinder including an annular piston about the rod, means by which operating fluid may be supplied to or exhausted from opposite sides of the piston means, locking elements carried about the rod on the inner side of the piston for radial expansion and contraction between inner positions in which they are free to move within the inner diameter of the cylinder and outer positions in which conical surfaces on their outer sides which are substantially complementary to the conical shoulder of the cylinder project outwardly from said diameter, a stop on the rod on the inner side of the locking elements, a locking ring on the piston, means on the locking ring and the locking elements for transmitting to the rod via the locking elements a relatively large axial component of the axially inwardly directed force due to operating fluid supplied to the outer side of the piston means in order to move the rod axially inwardly with the locking elements until the conical surfaces of the locking elements are radially opposite the cylinder shoulder, and then transmitting to the rod via the locking elements a relatively large radial component of such force in order to cause the locking elements to move radially outwardly with respect to the rod and the conical surfaces thereof to slide radially outwardly and axially inwardly along the cylinder shoulder as the rod continues to move axially inwardly with the locking elements to its inner position, said rod being locked against return movement from its inner to its outer position, upon exhaustion of operating fluid from said outer side of the piston, and means including another stop on the rod outwardly of the piston for transmitting to the rod the axially outwardly directed force due to the supply of operating fluid to the inner side of said piston and to cause the locking elements to slide radially inwardly and axially outwardly along the conical shoulder and then axially outwardly with the rod as the rod is returned to its outer position.

5. An actuator of the character defined in claim 4, wherein the inner diameter of said piston is sealably slidable along said rod and the outer diameter thereof is sealably slidable along the inner diameter of the cylinder.

6. An actuator of the character defined in claim 4, wherein the rod is hollow and extends sealably through the outer end of the cylinder into a chamber outwardly of the cylinder so as to be substantially pressure balanced.

7. An axially reciprocating, fluid-operated actuator, comprising a cylinder with a conical locking shoulder extending radially outwardly from its inner diameter and in an axial direction toward the inner end of the cylinder, a rod extending sealably through the inner end of the cylinder for axial reciprocation between inner and outer positions, piston means axially reciprocable within the cylinder including an annular piston about the rod, means by which operating fluid may be supplied to or exhausted from opposite sides of the piston means, locking elements carried about the rod on the inner side of the piston for radial expansion and contraction between inner positions in which they are free to move within the inner diameter of the cylinder and outer positions in which conical surfaces on their outer sides which are substantially complementary to the conical locking shoulder of the cylinder project outwardly from said diameter, a stop on the rod on the side of the locking elements opposite the piston, a locking ring on the piston having a first surface thereabout which is engageable with substantially complementary first surfaces on the locking elements to move the locking elements against the inner stop on the rod and thereby move the rod axially inwardly with the locking elements, and which is then slidable over said complementary first surfaces to wedge the locking elements radially outwardly with respect to the rod for sliding radially outwardly and axially inwardly along the cylinder shoulder as the rod and locking elements move further axially inwardly, in response to the supply of operating fluid to the outer side of the piston, and a second surface thereabout which is slidable over substantially complementary second surfaces on the locking elements, upon sliding of said first surface out of engagement with said first surfaces of the locking elements, so as to continue to wedge the locking elements radially outwardly for sliding further radially outwardly and axially inwardly along said cylinder shoulder as the rod and locking elements continue to move axially inwardly and until the rod reaches its inner position, in response to the continued supply of operating fluid to the outer side of the piston, said first surfaces forming a relatively large angle with respect to the rod axis, and said second surfaces forming a relatively small angle with respect thereto, and said rod being locked against return movement from its inner to its outer position, upon exhaustion of operating fluid from said outer side of the piston, and another stop on the rod on the outer side of the piston, so that when said second surface of the locking ring slides out of engagement with the second surfaces of the locking elements, as the locking ring is moved axially outwardly in response to the supply of operating fluid to the inner side of said piston, the locking elements will be released for sliding radially inwardly and axially outwardly along the cylinder shoulder and axially outwardly with the rod and the piston will engage with said outer stop on the rod for moving the rod, and thus the locking elements, axially outwardly with the piston.

8. An actuator of the character defined in claim 7, wherein the inner diameter of said piston is sealably slidable along said rod and the outer diameter thereof is sealably slidable along the inner diameter of the cylinder.

9. An actuator of the character defined in claim 7, wherein the inner ends of the locking elements have conical surfaces which extend radially outwardly in a direction toward the inner end of the cylinder for sliding along a substantially complementary conical surface of the inner stop of the rod, during radial expansion and contraction into and out of locking position.

10. An actuator of the character defined in claim 7, wherein the locking ring comprises circumferentially spaced-apart fingers which are pressed tightly about the rod as the second surface of the ring moves into sliding engagement with the second surfaces of the locking elements.

11. An actuator of the character defined in claim 10, including bolts connecting the locking elements to the rod for guided radial movement with respect thereto, and pins on the rod extending between the fingers so as to axially align the spaces between them with the bolts for movement thereover as the locking ring moves within the locking elements.

12. An actuator of the character defined in claim 7, wherein the rod is hollow and extends sealably through the outer end of the cylinder into a chamber outwardly of the cylinder so as to be substantially pressure balanced.

13. Valve apparatus, comprising a body having a flowway therethrough, a valve member movable within the body between flowway opening and closing positions, and an actuator for so moving the valve member, including a cylinder with a conical locking shoulder extending radially outwardly from its inner diameter and in an axial direction toward the inner end of the cylinder, a rod connected to the valve member and extending sealably through the inner end of the cylinder for axial reciprocation between an inner position to close the flowway and an outer position to open the flowway, piston means axially reciprocable within the cylinder, means by which operating fluid may be supplied to or exhausted from opposite sides of the piston means, locking elements carried about the rod for radial expansion and contraction between inner positions in which they are free to move within the inner diameter of the cylinder and outer positions in which conical surfaces on their outer sides which are substantially complementary to the conical shoulder of the cylinder project outwardly from said diameter, means for transmitting to the rod via the locking elements a relatively large axial component of the axially inwardly directed force due to operating fluid supplied to the outer side of the piston means in order to move the rod axially inwardly with the locking elements until the conical surfaces of the locking elements are radially opposite the cylinder shoulder, and then transmitting to the rod via the locking elements a relatively large radial component of such force in order to cause the locking elements to move radially outwardly with respect to the rod and the conical surfaces thereof to slide radially outwardly and axially inwardly along the conical cylinder shoulder as the rod continues to move axially inwardly with the locking elements to its inner position, said rod being locked against return movement from its inner to its outer position, upon exhaustion of operating fluid from said outer side of the piston means, and means for transmitting to the rod the axially outwardly directed force due to the supply of operating fluid to the inner side of said piston means and to cause the locking elements to slide radially inwardly and axially outwardly along the conical shoulder and then axially outwardly with the rod as the rod is returned to its outer position.

14. Valve apparatus of the character defined in claim 13, wherein the piston means comprises an annular piston whose inner diameter is sealably slidable along said rod and whose outer diameter is sealably slidable along the inner diameter of the cylinder.

15. Valve apparatus of the character defined in claim 13, wherein the piston means comprises an annular piston about the rod, and the rod is hollow and extends sealably through the outer end of the cylinder into a chamber outwardly of the cylinder so as to be substantially pressure balanced.

16. Valve apparatus, comprising a body having a flowway therethrough, a valve member movable within the body between flowway opening and closing positions, and an actuator for so moving the valve member, including a cylinder with a conical locking shoulder extending radially outwardly from its inner diameter and in an axial direction toward the inner end of the cylinder, a rod connected to the valve member and extending sealably through the inner end of the cylinder for axial reciprocation between an inner position to close the flowway and an outer position to open the flowway, piston means axially reciprocable within the cylinder including an annular piston about the rod, means by which operating fluid may be supplied to or exhausted from opposite sides of the piston means, locking elements carried about the rod on the inner side of the piston for radial expansion and contraction between inner positions in which they are free to move within the inner diameter of the cylinder and outer positions in which conical surfaces on their outer sides which are substantially complementary to the conical shoulder of the cylinder project outwardly from said diameter, a stop on the rod on the inner side of the locking elements, a locking ring on the piston, means on the locking ring and the locking elements for transmitting to the rod via the locking elements a relatively large axial component of the axially inwardly directed force due to operating fluid supplied to the outer side of the piston means in order to move the rod axially inwardly with the locking elements until the conical surfaces of the locking elements are radially opposite the cylinder shoulder, and then transmitting to the rod via the locking elements a relatively large radial component of such force in order to cause the locking elements to move radially outwardly with respect to the rod and the conical surfaces thereof to slide radially outwardly and axially inwardly along the cylinder shoulder as the rod continues to move axially inwardly with the locking elements to its inner position, said rod being locked against return movement from its inner to its outer position, upon exhaustion of operating fluid from said outer side of the piston, and means including another stop on the rod outwardly of the piston for transmitting to the rod the axially outwardly directed force due to the supply of operating fluid to the inner side of said piston and to cause the locking elements to slide radially inwardly and axially inwardly along the conical shoulder and then axially outwardly with the rod as the rod is returned to its outer position.

17. Valve apparatus of the character defined in claim 16, wherein the inner diameter of said piston is sealably slidable along said rod and the outer diameter thereof is sealably slidable along the inner diameter of the cylinder.

18. Valve apparatus of the character defined in claim 16, wherein the rod is hollow and extends sealably through the outer end of the cylinder into a chamber outwardly of the cylinder so as to be substantially pressure balanced.

19. Valve apparatus, comprising a body having a flowway therethrough, a valve member movable within the body between flowway opening and closing positions, and an actuator for so moving the valve member, including a cylinder with a conical locking-shoulder extending radially outwardly from its inner diameter and in an axial direction toward the inner end of the cylinder, a rod connected to the valve member and extending sealably through the inner end of the cylinder for axial reciprocation between an inner position to close the flowway and an outer position to open the flowway, piston means axially reciprocable within the cylinder including an annular piston about the rod, means by which operating fluid may be supplied to or exhausted from opposite sides of the piston means, locking elements carried about the rod on the inner side of the piston for radial expansion and contraction between inner positions in which they are free to move within the inner diameter of the cylinder and outer positions in which conical surfaces on their outer sides which are substantially complementary to the conical locking shoulder of the cylinder project outwardly from said diameter, a stop on the rod on the side of the locking elements opposite the piston, a locking ring on the piston having a first surface thereabout which is engageable with substantially complementary first surfaces on the locking elements to move the locking elements against the inner stop on the rod and thereby move the rod axially inwardly with the locking elements, and which is then slidable over said first surfaces to wedge the locking elements radially outwardly with respect to the rod for sliding radially outwardly and axially inwardly along the cylinder shoulder as the rod and locking elements move further axially inwardly, in response to the supply of operating fluid to the outer side of the piston, and a second surface thereabout which is slidable over substantially complementary second surfaces on the locking elements, upon sliding of said first surface out of engagement with said first surfaces of the locking elements, so as to continue to wedge the locking elements radially outwardly for sliding further radially outwardly and axially inwardly along said cylinder shoulder as the rod and locking elements continue to move axially inwardly and until the rod reaches its inner position, in response to the continued supply of operating fluid to the outer side of the piston, said first surfaces forming a relatively large angle with respect to the rod axis, and said second surfaces forming a relatively small angle with respect thereto, and said rod being locked against return movement from its inner to its outer position, upon exhaustion of operating fluid from said outer side of the piston, and another stop on the rod on the outer side of the piston, so that when said second surface of the locking ring slides out of engagement with the second surfaces of the locking elements, as the locking ring is moved axially outwardly in response to the supply of operating fluid to the inner side of said piston, the locking elements will be released for sliding radially inwardly and axially outwardly along the cylinder shoulder and axially outwardly with the rod and the piston will engage with said outer stop on the rod for moving the rod, and thus the locking elements, axially outwardly with the piston.

20. Valve apparatus of the character defined in claim 19, wherein the inner diameter of said piston is sealably slidable along said rod and the outer diameter thereof is sealably slidable along the inner diameter of the cylinder.

21. Valve apparatus of the character defined in claim 19, wherein the rod is hollow and extends sealably through the outer end of the cylinder into a chamber outwardly of the cylinder so as to be substantially pressure balanced.

22. A blowout preventer, comprising a housing having a bore therethrough and chambers therein intersecting opposite sides of the bore, a ram within each chamber, and an actuator for moving each ram between an outer position to open the bore and an inner position for engaging the other ram to close the bore, each actuator comprising a cylinder with a conical locking shoulder extending radially outwardly from its inner diameter and in an axial direction toward the inner end of the cylinder, a rod connected to a ram and extending sealably through the inner end of the cylinder for axial reciprocation between an inner position to close the bore and an outer position to open the bore, piston means axially reciprocable within the cylinder, means by which operating fluid may be supplied to or exhausted from opposite sides of the piston means, locking elements carried about the rod for radial expansion and contraction between inner positions in which they are free to move within the inner diameter of the cylinder and outer positions in which conical surfaces on their outer sides which are substantially complementary to the conical shoulder of the cylinder project outwardly from said diameter, means for transmitting to the rod via the locking elements a relatively large axial component of the axially inwardly directed force due to operating fluid supplied to the outer side of the piston means in order to move the rod axially inwardly with the locking elements until the conical surfaces of the locking elements are radially opposite the cylinder shoulder, and then transmitting to the rod via the locking elements a relatively large radial component of such force in order to cause the locking elements to move radially outwardly with respect to the rod and the conical surfaces thereof to slide radially outwardly and axially along the inwardly cylinder shoulder as the rod continues to move axially inwardly with the locking elements to its inner position, said rod being locked against return movement from its inner to its outer position, upon exhaustion of operating fluid from said outer side of the piston means, and means for transmitting to the rod the axially outwardly directed force due to the supply of operating fluid to the inner side of said piston means and to cause the locking elements to slide radially inwardly along the shoulder and then axially outwardly with the rod as the rod is returned to its outer position.

23. A blowout preventer of the character defined in claim 22, wherein the piston means comprises an annular piston whose inner diameter is sealably slidable along said rod and whose outer diameter is sealably slidable along the inner diameter of the cylinder.

24. A blowout preventer of the character defined in claim 22, wherein the piston means comprises an annular piston about the rod, and the rod is hollow and extends sealably through the outer end of the cylinder into a chamber outwardly of the cylinder so as to be substantially pressure balanced.

25. A blowout preventer, comprising a housing having a bore therethrough and chambers therein intersecting opposite sides of the bore, a ram within each chamber, and an actuator for moving each ram between an outer position to open the bore and an inner position for engaging the other ram to close the bore, each actuator comprising a cylinder with a conical locking shoulder extending radially outwardly from its inner diameter and in an axial direction toward the inner end of the cylinder, a rod connected to a ram and extending sealably through the inner end of the cylinder for axial reciprocation between an inner position to close the bore and an outer position to open the bore, piston means axially reciprocable within the cylinder including an annular pistion about the rod, means by which operating fluid may be supplied to or exhausted from opposite sides of the piston means, locking elements carried about the rod on the inner side of the piston for radial expansion and contraction between inner positions in which they are free to move within the inner diameter of the cylinder and outer positions in which conical surfaces on their outer sides which are substantially complementary to the conical shoulder of the cylinder project outwardly from said diameter, a stop on the rod on the inner side of the locking elements, a locking ring on the piston, means on the locking ring and the locking elements for transmitting to the rod via the locking elements a relatively large axial component of the axially inwardly directed force due to operating fluid supplied to the outer side of the piston means in order to move the rod axially inwardly with the locking elements until the conical surfaces of the locking elements are radially opposite the cylinder shoulder, and then transmitting to the rod via the locking elements a relatively large radial component of such force in order to cause the locking elements to move radially outwardly with respect to the rod and the conical surfaces thereof to slide radially outwardly and axially inwardly along the cylinder shoulder as the rod continues to move axially inwardly with the locking elements to its inner position, said rod being locked against return movement from its inner to its outer position, upon exhaustion of operating fluid from said outer side of the piston, and means including another stop on the rod outwardly of the piston for transmitting to the rod the axially outwardly directed force due to the supply of operating fluid to the inner side of said piston and to cause the locking elements to slide radially inwardly and axially outwardly along the conical shoulder and then axially outwardly with the rod as the rod is returned to its outer position.

26. A blowout preventer of the character defined in claim 25, wherein the inner diameter of said piston is sealably slidable along said rod and the outer diameter thereof is sealably slidable along the inner diameter of the cylinder.

27. A blowout preventer of the character defined in claim 25, wherein the rod is hollow and extends sealably through the outer end of the cylinder into a chamber outwardly of the cylinder so as to be substantially pressure balanced.

28. A blowout preventer, comprising a housing having a bore therethrough and chambers therein intersecting opposite sides of the bore, a ram within each chamber, and an actuator for moving each ram between an outer position to open the bore and an inner position for engaging the other ram to close the bore, each actuator comprising a cylinder with a conical locking shoulder extending radially outwardly from its inner diameter and in an axial direction toward the inner end of the cylinder, a rod connected to a ram and extending sealably through the inner end of the cylinder for axial reciprocation between an inner position to close the bore and an outer position to open the bore, piston means axially reciprocable within the cylinder including an annular piston about the rod, means by which operating fluid may be supplied to or exhausted from opposite sides of the piston means, locking elements carried about the rod on the inner side of the piston for radial expansion and contraction between inner positions in which they are free to move within the inner diameter of the cylinder and outer positions in which control surfaces on their outer sides which are substantially complementary to the conical locking shoulder of the cylinder project outwardly from said diameter, a stop on the rod on the side of the locking elements opposite the piston, a locking ring on the piston having a first surface thereabout which is engageable with substantially complementary first surfaces on the locking elements to move the locking elements against the inner stop on the rod and thereby move the rod axially inwardly with the locking elements, and which is then slidable over said first surfaces to wedge the locking elements radially outwardly with respect to the rod for sliding radially outwardly and axially inwardly along the cylinder shoulder as the rod and locking elements move further axially inwardly, in response to the supply of operating fluid to the outer side of the piston, and a second surface thereabout which is slidable over substantially complementary second surfaces on the locking elements, upon sliding of said first surface out of engagement with said first surfaces of the locking elements, so as to continue to wedge the locking elements radially outwardly for sliding further radially outwardly and axially inwardly along said cylinder shoulder as the rod and locking elements continue to move axially inwardly and until the rod reaches its inner position, in response to the continued supply of operating fluid to the outer side of the piston, said first surfaces forming a relatively large angle with respect to the rod axis, and said second surfaces forming a relatively small angle with respect thereto, and said rod being locked against return movement from its inner to its outer position, upon exhaustion of operating fluid from said outer side of the piston, and another stop on the rod on the outer side of the piston, so that when said second surface of the locking ring slides out of engagement with the second surfaces of the locking elements, as the locking ring is moved axially outwardly in response to the supply of operating fluid to the inner side of said piston, the locking elements will be released for sliding radially inwardly and axially outwardly along the cylinder shoulder and axially outwardly with the rod and the piston will engage with said outer stop on the rod for moving the rod, and thus the locking elements, axially outwardly with the piston.

29. A blowout preventer of the character defined in claim 28, wherein the inner diameter of said piston is sealably slidable along said rod and the outer diameter thereof is sealably slidable along the inner diameter of the cylinder.

30. A blowout preventer of the character defined in claim 28, wherein the rod is hollow and extends sealably through the outer end of the cylinder into a chamber outwardly of the cylinder so as to be substantially pressure balanced.

31. A blowout preventer of the character defined in claim 28, wherein the locking ring comprises circumferentially spaced-apart fingers which are pressed tightly about the rod as the second surface of the ring moves into sliding engagement with the second surfaces of the locking elements.

32. A blowout preventer of the character defined in claim 31, including bolts connecting the locking elements to the rod for guided radial movement with respect thereto, and pins on the rod extending between the fingers so as to axially align the spaces between them with the bolts for movement thereover as the locking ring moves within the locking elements.

* * * * *